US007560067B2

(12) United States Patent
Sherman

(10) Patent No.: US 7,560,067 B2
(45) Date of Patent: Jul. 14, 2009

(54) POWDER FRICTION FORMING

(76) Inventor: Andrew J. Sherman, 17201 Warrington Dr., Granada Hills, CA (US) 91344

( * ) Notice: Subject to any disclaimer, the term of this patent is extended or adjusted under 35 U.S.C. 154(b) by 0 days.

(21) Appl. No.: 10/194,187

(22) Filed: Jul. 12, 2002

(65) Prior Publication Data

US 2003/0012678 A1 Jan. 16, 2003

Related U.S. Application Data

(60) Provisional application No. 60/305,940, filed on Jul. 16, 2001, provisional application No. 60/333,863, filed on Nov. 27, 2001.

(51) Int. Cl.

| | |
|---|---|
| ***B22F 3/02*** | (2006.01) |
| ***B22F 3/18*** | (2006.01) |
| ***B23K 20/12*** | (2006.01) |
| *B22F 3/00* | (2006.01) |

(52) U.S. Cl. ..... 419/66; 419/5; 419/8; 419/69; 228/112.1

(58) Field of Classification Search ..... 419/8, 419/5, 66, 69; 228/112.1
See application file for complete search history.

(56) References Cited

U.S. PATENT DOCUMENTS

| | | | | |
|---|---|---|---|---|
| 1,050,880 | A * | 1/1913 | Wadsworth | 228/173.3 |
| 3,088,195 | A * | 5/1963 | Noethlich, Jr. et al. | 428/553 |
| 4,397,622 | A | 8/1983 | Childs et al. | |
| 4,602,954 | A * | 7/1986 | Davies et al. | 75/232 |
| 4,608,225 | A * | 8/1986 | Sakuramoto et al. | 419/5 |
| 4,612,256 | A * | 9/1986 | Neuhauser et al. | 428/547 |
| 4,622,189 | A * | 11/1986 | Bellis et al. | 264/112 |
| 4,681,733 | A * | 7/1987 | Konishi et al. | 419/8 |
| 4,726,101 | A * | 2/1988 | Draghi et al. | 29/889.1 |

(Continued)

FOREIGN PATENT DOCUMENTS

JP 11-320276 * 11/1999

(Continued)

OTHER PUBLICATIONS

Bunshah, R.F. (2001). Handbook of Hard Coatings. (pp. 77). William Andrew Publishing/Noyes. Online version available at: http://www.knovel.com/knovel2/Toc.jsp?BookID=146&VerticalID=0.*

(Continued)

*Primary Examiner*—Harry D. Wilkins, III
*Assistant Examiner*—Nicholas A. Smith
(74) *Attorney, Agent, or Firm*—Bruce A. Jagger

(57) ABSTRACT

A method of forming dense articles from metal or metal alloy powders by friction forming. A self supporting shaped deposit of powder is formed on a substrate. Relative movement is established between the shaped deposit and a friction forming tool. The forming end of the friction tool is urged into compressive contact with the shaped deposit so as to generate an amount of heat sufficient to plasticize the deposit and thereby form a dense article. The steps may be repeated to built up the article to any pre-desired thickness. The substrate may be removed to establish a free standing coherent article, or the article may be left tightly bonded to the substrate. The article is very uniform in both thickness and composition, and enjoys substantially full density and a very fine microstructure.

22 Claims, 2 Drawing Sheets

U.S. PATENT DOCUMENTS

| | | | | | |
|---|---|---|---|---|---|
| 4,930,675 | A | | 6/1990 | Bedford et al. | |
| 4,959,241 | A | * | 9/1990 | Thomas et al. | 427/11 |
| 4,961,901 | A | * | 10/1990 | Wullenweber et al. | 419/2 |
| 5,010,050 | A | * | 4/1991 | Wullenweber et al. | 502/301 |
| 5,049,450 | A | * | 9/1991 | Dorfman et al. | 428/570 |
| 5,183,390 | A | | 2/1993 | Amos | |
| 5,194,237 | A | * | 3/1993 | Cliche et al. | 423/440 |
| 5,207,371 | A | * | 5/1993 | Prinz et al. | 228/125 |
| 5,262,123 | A | | 11/1993 | Thomas et al. | |
| 5,460,317 | A | * | 10/1995 | Thomas et al. | 228/112.1 |
| 5,469,617 | A | * | 11/1995 | Thomas et al. | 29/889.21 |
| 5,697,545 | A | | 12/1997 | Jennings et al. | |
| 5,961,862 | A | | 10/1999 | Lewis et al. | |
| 6,025,014 | A | * | 2/2000 | Stango | 427/11 |
| 6,103,186 | A | * | 8/2000 | Sievers et al. | 419/8 |
| 6,154,958 | A | | 12/2000 | Trubenbach | |
| 6,183,690 | B1 | | 2/2001 | Yoo et al. | |
| 6,457,629 | B1 | * | 10/2002 | White | 228/112.1 |
| 2007/0077362 | A1 | * | 4/2007 | Ruzzo et al. | 427/446 |

FOREIGN PATENT DOCUMENTS

| | | | |
|---|---|---|---|
| JP | 11058454 | * | 11/1999 |

OTHER PUBLICATIONS

Metals Handbook Committe. Metals Handbook. 8th ed. vol. 1. Properties and Selection of Metals, American Society for Metals. , edited by Taylor Lyman et al.: Novelty Ohio 1961.

American Society of Tool and Manufacturing Engineers. Tool Engineers Handbook. 2nd ed., edited by Frank W. Wilson et al.: New York, The Maple Press Company, 1959.

Oberg, Erik and Jones, Franklin D. Machinery's Handbook. 19th ed., edited by Frank W. Wilson et al.: New York, Industrial Press Inc., 1959.

* cited by examiner

POWDER FRICTION FORMING

RELATED APPLICATIONS

This application claims the benefit of U.S. Provisional Application Ser. No. 60/305,940, filed Jul. 16, 2001, and U.S. Provisional Application Ser. No. 60/333,863, filed Nov. 27, 2001.

BACKGROUND OF THE INVENTION

1. Field of the Invention

The invention relates in general to the thermomechanical manufacturing of dense articles from powders and, in particular, to a method of forming dense articles from less dense preformed bodies of powders wherein the preformed bodies are plasticized and compressed by a process of frictional heating.

2. Description of the Prior Art

The use of thermomechanical processes to bond or weld articles together and to form coatings is well known. The use of powder metallurgy to form net or near-net shape parts is also well known.

Heat generated by moving materials relative to one another under pressure had been previously proposed for the plasticizing of powdered materials so as to form extruded articles from those powdered materials. See, for example, Thomas et al. U.S. Pat. No. 5,262,123. Thomas et al. propose to plasticize powdered materials by frictional heating, and to extrude the resulting materials. The loose powdered materials may be confined in cavities in a consumable rotating probe, or confined between non-consumable counter-rotating members. In the proposed configuration where the loose powdered materials are confined in cavities within a consumable probe, the material of the probe is mixed with the loose powdered materials as they are plasticized, and the resulting mixed material is extruded. In the configuration where loose powdered materials are confined between non-consumable counter-rotating members, the loose powders are confined by some other supporting structure, such as a chamber, until the plasticized mass is extruded. Unconfined loose powders can not be utilized according to Thomas et al. Where a consumable probe confines powdered metal therewithin, the probe must have sufficient structural strength to withstand the loads applied by moving it and simultaneously urging it into engagement with an opposing member. Also, the material of which the probe or rod is composed must be a desirable component in the final article, because it will inevitably be there. Thomas et al do not utilize unconfined loose powders. The applicability of the teachings of Thomas et al. to a wide variety of applications, particularly irregular shapes, is thus limited. The extruded mass may be broken up and put through the process again. That is, according to Thomas et al., it may be reformed.

Childs et al. U.S. Pat. No. 4,397,622 discloses a friction-actuated "Conform" process in which loose particulate copper or aluminum is extruded under pressure to form elongated solid objects.

In friction welding, frictional forces may be used to bond together components made, for example, of dissimilar materials. U.S. Pat. No. 5,697,545 to Jennings et al., disclose a friction welding operation in which oscillatory relative movement between two solid components under load generates enough heat to weld the two solid components together. Powders are not involved.

In friction surfacing operations, frictional forces are used to clad the surface structure of an article. For example, U.S. Pat. No. 5,183,390 to Amos and U.S. Pat. No. 4,930,675 to Bedford et al. teach friction surfacing with material derived from a solid consumable friction rod. The solid rod or probe has sufficient strength to withstand the thermal and mechanical forces imposed upon it. The composition of the facing is determined largely by the composition of the rod. In conventional friction welding and friction surfacing operations, frictional forces are relied on to generate heat in an amount sufficient to locally plasticize solid materials.

In a different art, but also known, is powder metallurgy. In powder metallurgy, net or near-net shape articles are conventionally produced by hot or cold pressing loose metallic powders, often with high temperature steps where the temperatures are at or above the melting points of at least some of the constituents. The metallic powders initially exist in a loose or non-coherent state. Typically, the required amount of raw material powder is placed within a casting or mold that is hydraulically pressed under heat. The powder is sintered under the compression and heat, and net or near-net shaped articles are formed. Undesired grain growth is often experienced. The heat is not frictionally generated. Utilizing powder metallurgy techniques to form articles is advantageous, particularly for difficult to work materials, or where physical properties are desired that are not obtainable by the application of other metallurgical processes. Capital equipment requirements are sometimes very substantial, as are processing costs. It is difficult and expensive to achieve substantially full density with many metallurgical powder consolidation processes.

These and other difficulties of the prior art have been overcome according to the present invention.

BRIEF SUMMARY OF THE INVENTION

The present invention contemplates a method wherein friction forming techniques are applied to form a dense article from a shaped plasticizable powder deposit. According to the present invention, a shaped deposit of the plasticizable powder is formed on a substrate.

The shaped deposit is treated, for example, by thermal or additive binders so as to render the deposit self-sustaining. The deposit is not fully dense. It is bound together so that it retains its shape on the substrate. Typically, the density of the deposit is less than approximately 75 percent of full density, although densities of from, for example, approximately 10 percent to 90 percent can be employed if desired. The preferred density of the shaped deposit is generally determined by what is necessary to allow the deposit to reliably hold its shape prior to and during frictional densification, and varies from one powder mixture to another. In general, the cost goes up as the density of the deposit increases, sometimes exponentially. There is usually no useful purpose served by increasing the density of the deposit beyond that that is required to maintain the shape of the deposit during processing.

Relative movement is established between the deposit and a friction tool according to conventional friction forming procedures. The friction tool is provided with a forming end at one end. The forming end is designed to contact the deposit and to work it into a denser article, preferably a substantially fully dense article by plasticizing, but not melting, the deposit. In general, the forming end moves in an orbital, oscillatory or circular motion, and the deposit is translated slowly past the forming end by movement of the deposit, the friction tool, or both. The friction tool is loaded so that the forming end bears against the deposit with sufficient force, when combined with the relative movement, to plasticize the deposit.

The forming end may be composed of a material that is consumed during the friction forming operation, or it may be composed of a material that is not significantly consumed during the operation. Where the deliberate consumption of the friction tool is contemplated, the material from which the tool is composed appears in the final article in significant proportions. The tool may thus be deliberately used to adjust the composition of the final article. Where the tool is not intended to contribute to the composition of the final article, at least the forming end is composed of a wear resistant material that does not contribute significantly to the final properties of the article. The nature of friction forming is such that for most materials at least a trace of the friction tool will appear in the final article. The system is adjusted so that these inevitable traces do not significantly alter the desired properties of the final article.

The forming end of the friction tool is urged into compressive moving contact with the deposit. The heat and pressure generated by this compressive moving contact is allowed to plasticize and densify the deposit into a dense article without reaching the melting point of the deposit. The degree of densification is controllable from, for example, approximately 10 percent to substantially 100 percent. Densification is conveniently determined by measuring either weight per volume or change in thickness. If, for example, the average thickness of a dense article is 0.1 inches, while the average thickness of the shaped deposit from which it was formed was 0.2 inches, the degree of densification is considered to be 50 percent.

The shaped deposit must be non-friable. That is, the deposit must not shatter before plasticization takes place. If the shaped deposit shatters when first touched by the forming end of the friction tool the material will scatter and some will likely be lost. The resulting densified article will not have a uniform or predictable thickness. The deposit should stay substantially intact at the site where it is deposited until plasticization is accomplished. The test for determining whether a shaped deposit is non-frangible is a very practical one. If substantially all of the shaped deposit stays at the site of deposition until plasticization occurs, the deposit is non-frangible. Non-frangible shaped deposits result in dense articles with substantially uniform thicknesses. That is, the thickness of the article is reliably determined by the thickness of the shaped deposit. The thickness of the article and its uniformity are controlled by the accurate application of the shaped deposit.

Frictional densification procedures according to the present invention form net or near-net shaped dense articles from powders without the expense and difficulties that are typically associated with the full densification of powdered metallurgical materials. The properties of such articles equal or exceed those typically achieved by conventional powdered metal densification procedures. In some instances the properties of such articles are not achievable by any other procedure.

The uniformity of particle distribution, and the fineness of the grains in densified articles made according to the present frictional densification invention are generally superior to those achievable by other procedures. The growth in grain size is minimal because the shaped deposit is plasticized at temperatures below the melting point of the plasticizable material. In a powdered system, which contains, for example, tungsten carbide and mild steel, the mild steel powder will be plasticized at temperatures below its melting point, and well below the temperature at which tungsten carbide exhibits significant grain growth. Substantially full (100 percent) densification of this system can be achieved without significant tungsten carbide grain growth. Intimate mixing of the powders is accomplished before they are formed into a shaped deposit. Appropriate mixing and depositing procedures are selected so that segregation or grading of the particles in the shaped deposit is substantially avoided. The resulting uniform shaped deposit is not significantly segregated or graded during the frictional densification procedure. The resulting dense articles are typically characterized by fine microstructures, substantially no dilution with the substrate, and a very strong bond with the substrate. This combination of characteristics is generally impossible to achieve with conventional higher temperature processing procedures.

The availability of computerized control systems permits an irregularly shaped deposit to be frictionally densified. A friction tool or probe can, for example, be guided over a surface with an irregular topography so as to apply pressure uniformly throughout.

The shaped deposit is supported by a substrate that is capable of resisting the force of the frictional densification procedure. After the shaped deposit has been densified, the resulting article may be left on the substrate as a coating, or removed to provide a stand-alone article. Bonding between the substrate and the article is generally excellent. The substrate can be removed, for example, by leaching, or, where possible, by mechanical operations.

The nature of the frictional densification process is such that it is typically applied to relatively thin layers of powdered materials. In this way the entire thickness of the layer is plasticized at one time. Substantial thickness is achieved by successively applying and densifying thin layers of powdered material over one another. The permissible thickness of the shaped deposits depends on the materials, however, shaped deposit thicknesses of less than approximately 0.2, and, preferably less than about 0.1 inches have been found to be satisfactory. The compositions of all of the successive layers need not be the same. The properties of an article may be graded by changing the compositions of the various shaped layers that are successively applied to build up the article. Also, varying the composition of the powders within a single layer may change the properties of a particular layer. For example, if part of a layer is laid down on a substrate, the composition is changed, and the rest of the layer is laid down, the frictional densification of the layer will fuse the parts of the layer into a single mass, the parts of which exhibit different characteristics. The composition may be changed, for example, as to particle size, particle shape, particle size distribution, particle surface preparation, chemical composition, or the like. The density of a single shaped deposit may be varied over the surface of a substrate, if desired, to vary the thickness of the resulting article. Also, the thickness of a single shaped deposit may be varied to vary the thickness of the resulting article.

The present invention is particularly applicable to the formation of dense articles that are difficult or impossible to produce using conventional metallurgical techniques. Various wear and corrosion resistant articles may be formed according to the present invention. Composite materials that include powdered diamond, borides, carbides, carbonaceous materials, or the like, as inclusions are easily produced utilizing frictional densification procedures of the present invention.

BRIEF DESCRIPTION OF THE DRAWINGS

Referring particularly to the drawings for the purposes of illustration only and not limitation.

DETAILED DESCRIPTION OF THE PREFERRED EMBODIMENTS

Figure 1:
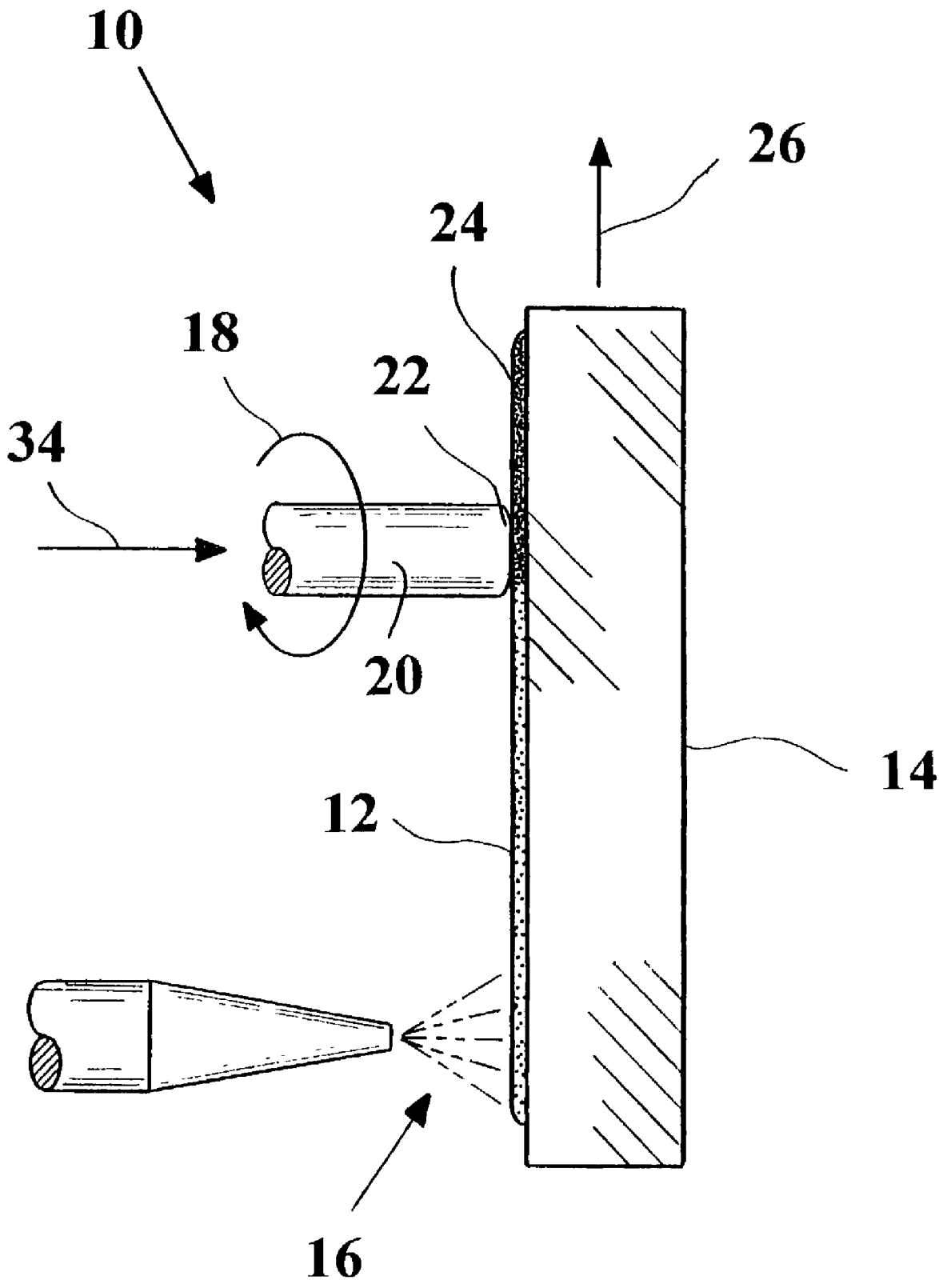
FIG. 1 is a schematic side view that illustrates a frictional densification process according to the present invention wherein a shaped deposit of powder is formed on a flat plate and subjected to frictional densification.

Referring particularly to the drawings, and particularly to FIG. 1, there is diagrammatically illustrated generally at 10 a frictional densification process of the present invention. The first step in the process is to apply a self-sustaining deposit of powder material 12 on a supporting substrate 14. The powder material is applied to the substrate as illustrated generally shown at 16 so as to form a shaped deposit 12. The shaped deposit 12 may be formed from thermally softened powders that bind to one another, or from powders that are bound together by a binding agent. The shaped deposit 12 may be applied as an inclusion in a paint or organic binder containing slurry. Slip casting procedures may be utilized, if desired. Any organic binders are generally driven off in a sintering or pre-sintering operation before friction forming takes place. In one embodiment, the powder is applied via a thermal spray or high velocity oxy-fuel torch so that the softened particles bind to one another and the substrate with sufficient tenacity to remain intact until they are plasticized by a friction tool. Other application procedures may be employed to form the shaped deposit, as desired. Relative movement, indicated at 18 is then established between friction tool 20 and the shaped deposit 12. The forming end 22 of the friction tool is urged into compressive contact with the shaped deposit. Friction generates an amount of heat sufficient to plasticize the powdered material to form a dense article 24. The plasticizing occurs locally, and as indicated at 26, the substrate is moved to allow the friction tool to gradually move along the shaped deposit 12 until the entire shaped deposit has been frictionally densified. A uniform dense article is thus formed.

It is generally preferred that the friction tool 20, or at least the forming end 22 of the friction tool, be made of a substantially non-consumable material, that is, one not intended to break down and mix with the locally plasticized body of powder material. Some suitable substantially non-consumable materials, depending upon the nature of the powders in the shaped deposit, include, for example, tool steel, cemented carbide, diamond, and the like. Other materials may be used, as desired. Although a substantially non-consumable friction tool is generally preferred, a consumable friction tool may be used, if desired.

The substrate or support structure may be of any desired shape, for example flat, cylindrical, conical, elliptical, or the like. A flat or cylindrical substrate surface is preferred for use with manual control systems due to the simplicity and ease of use of such substrate surfaces, however, any desired configuration, compound, arcuate, angular, or the like may be used with appropriate control systems, if desired. For most applications, the shape of the substrate surface will determine the shape of the resultant dense article.

The powders from which the shaped deposit 12 is formed may be selected from metallic powders such as, for example, elemental aluminum (Al), nickel (Ni), iron (Fe), cobalt (Co), titanium (Ti), copper (Cu), niobium (Nb), tantalum (Ta), magnesium (Mg), Beryllium (Be), rhenium (Re), zinc (Zn), chromium (Cr), vanadium (V), gold (Au), silver (Ag), antimony (Sb), bismuth (Bi), lead (Pb), their respective alloys, and mixtures thereof. Whatever the composition of the powders, the powder particles should have a fine granular structure, that is, preferably an average particle size of from approximately 0.1 to 20, and preferably from approximately 0.5 to 2 microns.

Many different methods of forming the powder into a shaped deposit may be used, as may be desired, so long as control of the uniformity of the composition and its physical dimensions are achieved without exposing the shaped deposit to temperatures that would induce undesired grain growth. Generally, it is desirable to apply the powder in the form of a shaped layer 12 having a thickness of from approximately 0.020 to 0.050 inches, the thickness shown in FIG. 1 being greatly exaggerated for purposes of illustration. Generally, the thickness of the shaped deposit 12 is uniform throughout the deposit, although variations in thickness and composition may be employed if desired to achieve an article with graded dimensions or characteristics, or both. It is to be appreciated that any applicable deposit forming/application technique may be used for applying the powder to the substrate so long as a deposit is formed that will hold together in place until it is plasticized. The support structure 14 may be separated from the dense article to form a free standing article or it may remain so that the article functions as a high strength, wear resistant coating or facing on the support structure 14.

Figure 2:
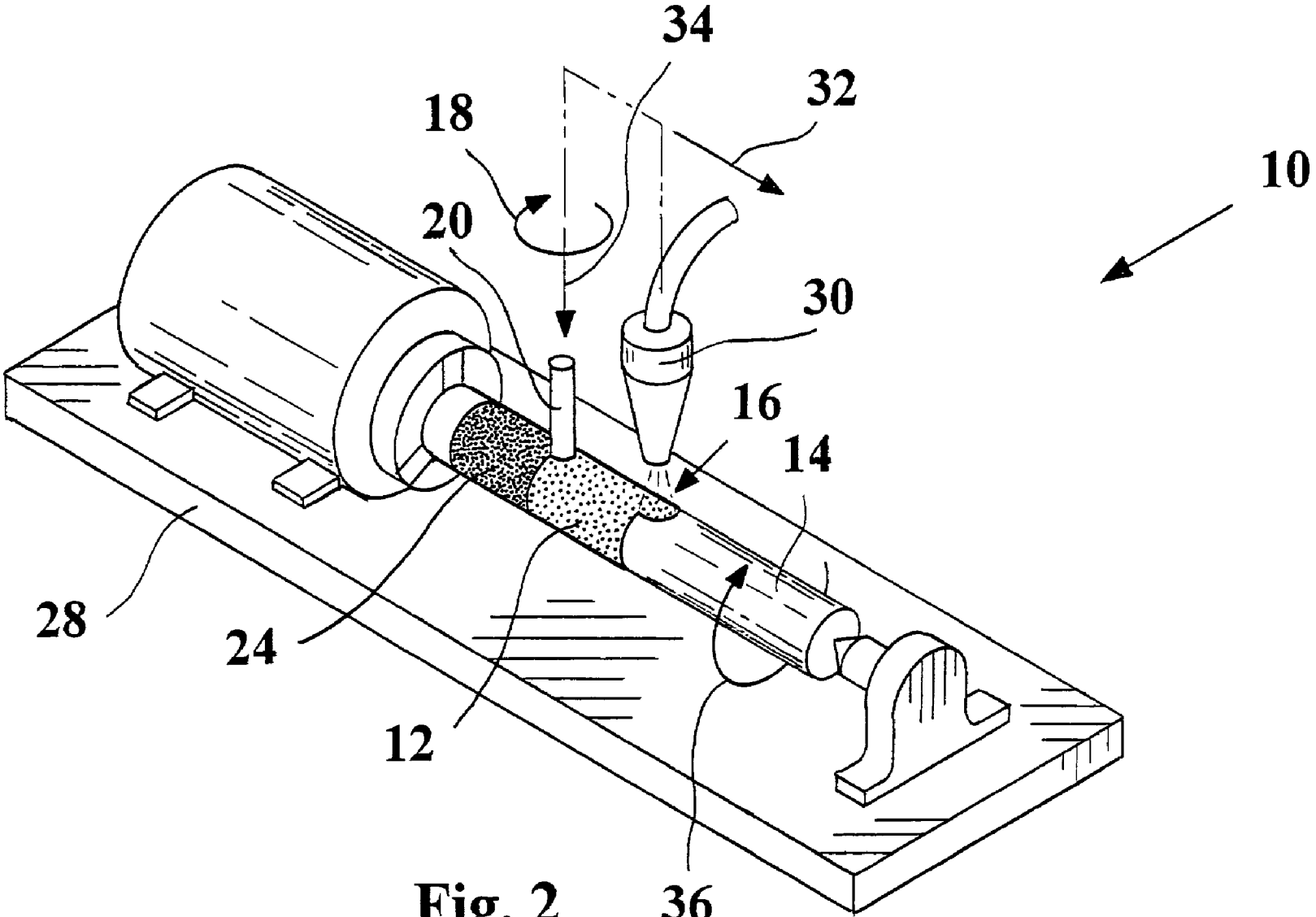
FIG. 2 is a schematic isometric view that illustrates a frictional densification process according to the present invention wherein a shaped deposit of powder is formed on a circular rotatable mandrel and then subjected to frictional densification.

In a preferred embodiment referred to for purposes of illustration only, shown in FIG. 2, a substrate 14 is configured as a cylindrical mandrel mounted on lathe 28. The shaped deposit 12 is applied via thermal spray 30 as the mandrel rotates. The friction tool 20 generally rotates rapidly about its own axis, shown at 18, while both the thermal spray and friction tool 20 are moved laterally along the lathe, as indicated at 32, so that the dense article 24 is formed as a tightly bonded layer over the entire cylindrical mandrel surface. The process is continually repeated thereby building the thickness of the article 24 to any desired thickness.

In the embodiment shown in FIG. 2, it is desirable to rotate the friction tool 20 between approximately 10,000 to 30,000 revolutions per minute, illustrated at 18, while maintaining between approximately 10 to 100 pounds of compressive force on the tool 20 that frictionally bears against the shaped deposit 12. Various modes of movement may be employed for the friction tool 20, including, for example, circular, oscillatory, orbital, or the like. In all of these modes the movement is approximately about the longitudinal axis of the tool 20. The traversal speed of the friction tool 20 over the shaped deposit 12, indicated at 32, is desirably set between approximately 0.01 and 1, and preferably between approximately 0.01 and 0.4 inches per second. The approximately axially applied force is indicated at 34. The mandrel rotation, indicated at 36, is desirably set to provide a tangential surface speed between the friction tool 20 and the shaped deposit 12 of from approximately 0.01 to 20, and preferably from 0.05 to 1 inches per second. The tangential movement of the friction tool 20 relative to the shaped deposit 12 thus consists of two components, that provided by rotation 36, and that provided by translational movement 32. The optimum rates of friction tool movement, tangential movement, and compressive force are determined by empirical observation of the results achieved at various settings with the particular system in use, and vary from system to system. In general, the optimum rates are those at which the article reaches the desired degree of densification in about the shortest time. The degree of densification is determined by conventional inspection of the dense article. Equipment, substrate or other limitations in the system may dictate that less than optimum rates of production be employed. Other characteristics, such as, for example, the desired finish on the article may also be considered in arriving at the optimum rate of production. Although FIG. 2 shows the shaped layer of powder 12 being applied simultaneously, but ahead of, the friction tool 20 as it works the layer, if desired, the complete shaped layer may also be applied prior to the commencement of the working of the layer with the friction tool. Three dense articles were formed according to the present invention as described in the following specific examples.

EXAMPLE 1

Al/SiC Tube

Referring to FIG. 2 for a general schematic representation of the operation, an aluminum/silicon carbide composite powder was applied, using a high velocity oxy-fuel torch, to a rotating leachable ceramic mandrel having an outside diameter of about 2 inches to form a shaped deposit in the form of a cylindrical layer adhered to the mandrel. The shaped deposit had a composition of about 45 vol. percent silicon carbide and 55 vol. percent aluminum, and the thickness of the deposit was about 0.050 inches. The deposit was substantially uniform in thickness and composition throughout. A cemented carbide cylindrical friction tool having a diameter of approximately 0.25 inches was rotated at about 25,000 revolutions per minute while applying a compressive force of about 15 pounds force generally axially to the friction tool. The traversal speed of the friction tool along the longitudinal axis of the mandrel was set at about 0.010 inches per revolution, and the rotational speed of the mandrel was set at about 120 revolutions per minute. The first application produced a substantially fully dense article having a thickness of about 0.03 inches with a greater than 98 percent dense. The process was repeated until a total article thickness of about 0.10 inches was achieved. The spraying and friction working were done simultaneously. The mandrel was then leached and separated from the dense article. The resultant dense article was a free standing Al/SiC tube having superior mechanical properties as compared to conventional Al/SiC tubes. The structure of the tube was extremely fine grained and uniform both as to composition and thickness. Desirably, the process produced no wasted material. A trace of tool steel from the friction tool appeared in the finished tube, but it did not significantly influence the characteristics of the tube. Replacing the tool steel forming tool with a tungsten carbide tipped tool substantially eliminates the presence of forming tool material in the tube.

Repetition of this Example 1 using shaped deposits having from about 50 to 70 weight percent aluminum and ranging in thickness from about 0.03 to 0.07 inches produces satisfactory results. Rotating the tool at from about 10,000 to 20,000 revolutions per minute, with compressive forces from about 10 to 100 pounds force, traversal speeds of from 0.01 to 0.1 inches per second, and mandrel rotation speeds to provide movement of the mandrel surface relative to the forming end of the friction tool of from about 0.5 to 20 inches per second produces satisfactory results.

EXAMPLE 2

W/Ni—Fe—Co Shaped Charge Liner

Referring to FIG. 2 for a general schematic of the operation, a tungsten heavy metal alloy powder having an average particle size of about 3 microns, and an approximate composition of 90 weight percent tungsten, 7 weight percent nickel, and 3 weight percent iron was mixed with a polyvinyl alcohol binder and sprayed onto a specially shaped conical copper mandrel (not shown) to form a shaped deposit having a substantially uniform thickness of approximately 0.050 inches. The right conical mandrel had a major diameter of 2 inches, and a radiused point having a radius of 0.25 inches. The application of the shaped layer of powder was completed prior to being worked by the friction tool. The polyvinyl alcohol binder was burned off at 350 degrees Celsius. The resulting tungsten coating was deoxidized at 650 degrees Celsius in hydrogen, followed by presintering at 900 degrees Celsius for about 45 minutes. The conical shaped mandrel with the resulting porous shaped metallic deposit on it was then placed on the lathe. A ¼ inch cylindrical tungsten carbide forming tool was employed. The forming tool was rotated at about 25,000 revolutions per minute. The forming tool was loaded at about 15 pounds, and moved at a surface feed rate of about 0.0025 inches per rotation. The deposit is plasticized, but not melted. The resulting dense conical article had an initial thickness of about 0.03 inches and a compacted thickness of about 0.015 inches with a greater than 98 percent densification. The process was repeated with intermediate stress annealing steps (at about every 0.125 inches of thickness) until a conical article with a uniform wall thickness of about 0.4 inches was achieved. The copper mandrel was then leached from the conical substantially fully dense article. The resulting conical shell had a sub-micron grain structure, a very uniform thickness and composition, with effectively zero porosity. The surface structure also appeared to be highly polished, and the article was well suited for use as an explosively formed penetrator or shaped charge liner.

EXAMPLE 3

WC/Co Coated Rod

A powder comprising tungsten carbide and 12 weight percent cobalt was applied to a rotating cylindrical tool steel mandrel using a high velocity oxy-fuel torch. The powder had an average primary particle size of about 0.8 microns. The applied thickness of the shaped powder deposit was about 0.025 inches which at substantially full densification was about 0.017 inches. A 0.25-inch diameter cemented carbide friction tool was used, traversing the lathe at a rate of about 0.01 inches advanced for each rotation of the mandrel while the mandrel was spinning at a rate of about 360 revolutions per minute. About 10 pounds were applied to the friction tool. There was better than about a 99 percent densification. The resultant coherent article comprised a substantially fully dense nano-crystalline tungsten-carbide coating strongly bonded to the tool steel mandrel and having exceptional wear resistance characteristics.

What have been described are preferred embodiments in which modifications and changes may be made without departing from the spirit and scope of the accompanying claims. As those skilled in the art realize the present invention can be adapted to produce a wide variety of different dense articles from an almost infinite combination of powder materials other than those disclosed in the specific examples provided herein.

What is claimed is:

1. A method of friction forming a substantially fully dense article from unshaped powder, said unshaped powder comprising plasticizable metallic powder, the method comprising the steps of:

preparing a shaped deposit from said unshaped powder by applying said unshaped powder to a substrate to form such unshaped powder into said shaped deposit on said substrate substantially without melting said plasticizable metallic powder or said shaped deposit, said shaped deposit being substantially non-frangible, self-sustaining, and less than substantially fully dense; and urging a friction tool into heat generating, frictional, compressive, and relative moving contact with said shaped deposit while said shaped deposit remains on said substrate, said shaped deposit being heated by said heat generating, frictional, compressive, and relative moving contact to substantially plasticize but not melt said shaped deposit, whereby said shaped deposit is plasticized and densified into said substantially fully dense article.

2. A method of friction forming a substantially fully dense article of claim 1 wherein said preparing comprises binding said unshaped powder into said shaped deposit with a binding agent.

3. A method of friction forming a substantially fully dense article of claim 1 including separating said substantially fully dense article from said substrate.

4. A method of friction forming a substantially fully dense article of claim 1 including repeating said steps of preparing and urging until said shaped deposit achieves a pre-determined thickness.

5. A method of friction forming a substantially fully dense article of claim 1 wherein said friction tool includes a forming end, and including selecting a said forming end composed of a substantially non-consumable wear resistant material.

6. A method of friction forming a substantially fully dense article of claim 1 including selecting a said unshaped powder comprising a loose metallic plasticizable powder.

7. A method of friction forming a substantially fully dense article of claim 1 including selecting a said unshaped powder comprising loose metallic and ceramic particles.

8. A method of friction forming a substantially fully dense article of claim 1 wherein said preparing comprises utilizing a thermal spray.

9. A method of friction forming a substantially fully dense article of claim 1 including forming said shaped deposit to a thickness of from approximately 0.01 to 0.2 inches.

10. A method of friction forming a substantially fully dense article of claim 1 including selecting an unshaped powder comprising a loose metal coated ceramic plasticizable powder.

11. A method of friction forming a substantially fully dense article of claim 1 including after said steps of preparing and urging, selecting a different unshaped powder and repeating said steps of preparing and urging.

12. A method of friction forming a substantially fully dense article of claim 1 including selecting a damaged substrate and carrying out said method to repair said substrate.

13. A method of friction forming a substantially fully dense article of claim 1 including selecting a said unshaped powder comprising metallic and non-metallic particles.

14. A method of friction forming a substantially fully dense article of claim 11 including carrying out said selecting and repeating at least three times.

15. A method of friction forming a substantially fully dense article of claim 4 including carrying out said repeating until said substantially fully dense article reaches a thickness of from approximately 0.01 to 0.15 inches.

16. A method of friction forming a dense article of claim 1 including selecting an unshaped powder comprising loose metallic and carbonaceous particles.

17. A method of friction forming a substantially fully dense article of claim 1 including allowing said shaped deposit to bond to said substrate.

18. A method of friction forming a substantially fully dense article of claim 1 wherein said relative moving comprises moving said friction tool and holding said substrate stationary.

19. A method of friction forming a substantially fully dense article from unshaped powder, said unshaped powder comprising plasticizable metallic powder, the method comprising the steps of:

thermally softening said plasticizable metallic powder to form softened but substantially unmelted particles of said plasticizable metallic powder, and allowing said softened particles to bind to one another on a substrate to form a deposit that is substantially self sustaining, shaped, and substantially non frangible, said deposit being less than approximately 75 percent dense;

establishing relative movement between said deposit and a friction tool; and urging said friction tool into frictionally heated compressive contact with said deposit while said deposit remains on said substrate and while continuing said relative movement to frictionally heat, plasticize, and densify said deposit into said substantially fully dense article without melting said deposit.

20. A method of friction forming a substantially fully dense article from unshaped powder, said unshaped powder comprising plasticizable metallic powder, the method comprising the steps of:

thermally spraying said unshaped powder to form thermally plasticized but substantially unmelted plasticizable metallic powder particles, and allowing said plasticized plasticizable metallic powder particles to bind to one another on a substrate to form a shaped deposit, said shaped deposit being unmelted, self-sustaining on said substrate, substantially non-frangible, and less than approximately 90 percent dense;

establishing relative movement between said shaped deposit and a friction tool; and urging said friction tool into compressive contact with said shaped deposit while said shaped deposit remains on said substrate and while continuing said relative movement to frictionally heat, plasticize, and densify said shaped deposit into said substantially fully dense article without melting said shaped deposit.

21. A method of friction forming a substantially fully dense article from unshaped powder, said unshaped powder comprising plasticizable metallic powder, said forming being accomplished without melting said plasticizable metallic powder, the method comprising the steps of:

forming a shaped deposit of said unshaped powder on said substrate, said forming comprising thermally spraying said unshaped powder onto said substrate to form said shaped deposit from said unshaped powder, said shaped deposit comprising plasticized but substantially unmelted plasticizable metallic powder particles bound to one another, said shaped deposit being self-sustaining on said substrate, and being less than approximately 90 percent dense;

friction forming said shaped deposit to plasticize and densify said shaped deposit into said substantially fully dense article, said friction forming being carried out without melting said shaped deposit, said shaped deposit being sufficiently non-frangible to substantially resist being dislodged from said substrate during said friction forming.

22. A method of friction forming a substantially fully dense article from unshaped powder, said unshaped powder comprising plasticizable powder particles, said unshaped powder comprising metal and ceramic particles, the method comprising the steps of:

forming a shaped deposit of said unshaped powder particles on said substrate, said forming comprising thermally spraying said unshaped powder onto said substrate to form said shaped deposit, said plasticizable powder particles being plasticized by said thermal spraying to bind to one another but not substantially melted, said shaped deposit being self-sustaining on said substrate and less than approximately 90 percent dense; and friction forming said shaped deposit to plasticize and densify said shaped deposit into said substantially fully dense article substantially without melting said plasticizable powder particles in said shaped deposit, said shaped deposit being sufficiently non-frangible to substantially resist being dislodged from said substrate during said friction forming, said friction forming comprising relatively moving a friction tool under compression against said shaped deposit.

* * * * *